US005118150A

United States Patent [19]

Jarrett

[11] Patent Number: 5,118,150

[45] Date of Patent: Jun. 2, 1992

[54] COMPACT ELECTRIC STRIKE

[75] Inventor: Alastair W. Jarrett, Fullerton, Calif.

[73] Assignee: Adams Rite Manufacturing Company, City of Industry, Calif.

[21] Appl. No.: 721,871

[22] Filed: Jun. 26, 1991

[51] Int. Cl.[5] ..... E05B 15/02

[52] U.S. Cl. ..... 292/341.16

[58] Field of Search ..... 292/201, 216, 341.16, 292/341.17

[56] References Cited

U.S. PATENT DOCUMENTS

| | | | |
|---|---|---|---|
| 277,628 | 5/1883 | Sullivan | 292/341.16 |
| 358,975 | 3/1887 | Henzel | 292/341.16 |
| 420,834 | 2/1890 | Seib | 292/341.16 |
| 1,072,996 | 9/1913 | Schneider | 292/341.16 |
| 1,501,228 | 7/1924 | Martin | 292/341.16 |
| 1,949,850 | 3/1934 | Willard | 292/341.16 |
| 3,122,388 | 2/1964 | Powers | 292/341.16 |
| 3,183,027 | 5/1965 | Powers | 292/40 |
| 3,188,129 | 6/1965 | Broch | 292/341.16 |
| 3,455,591 | 7/1969 | Powers | 292/335 |
| 3,543,547 | 12/1970 | Sugiyama | 292/241.16 |
| 3,638,984 | 2/1972 | Davidson | 292/341.16 |
| 3,640,560 | 2/1972 | Zawadzki et al. | 292/341.16 |
| 3,804,442 | 4/1974 | Powers | 292/341.16 |
| 3,861,727 | 1/1975 | Froerup et al. | 292/341.16 |
| 4,491,354 | 1/1985 | Williams | 292/148 |
| 4,626,010 | 12/1986 | Hanchett, Jr. et al. | 292/341.16 |
| 4,756,566 | 7/1988 | Logas | 292/341.16 |
| 4,917,425 | 4/1990 | Logas | 292/341.16 |

*Primary Examiner*—Richard E. Moore

*Attorney, Agent, or Firm*—William W. Haefliger

[57] ABSTRACT

An electrical release door strike comprising a carrier frame; a strike bolt carried by the frame for pivoting when released, allowing door opening, the bolt adapted to receive and resist door opening force prior to the pivoting; structure carried by the frame to release the strike bolt for such pivoting, including first, second and third arms; the first arm movable from a first position blocking bolt pivoting to a second position allowing bolt pivoting to in turn allow the door opening, the second arm movable from a primary position in which it holds the first arm in the first position to a secondary position in which it allows the first arm movement to the second position, and the third arm movable from an initial position in which it holds the second arm in the primary position to a subsequent position in which it allows movement of the second arm to the secondary position; and additional structures including an element carried by the bolt and movable relative thereto to signal the presence of a door part adjacent the bolt.

21 Claims, 5 Drawing Sheets

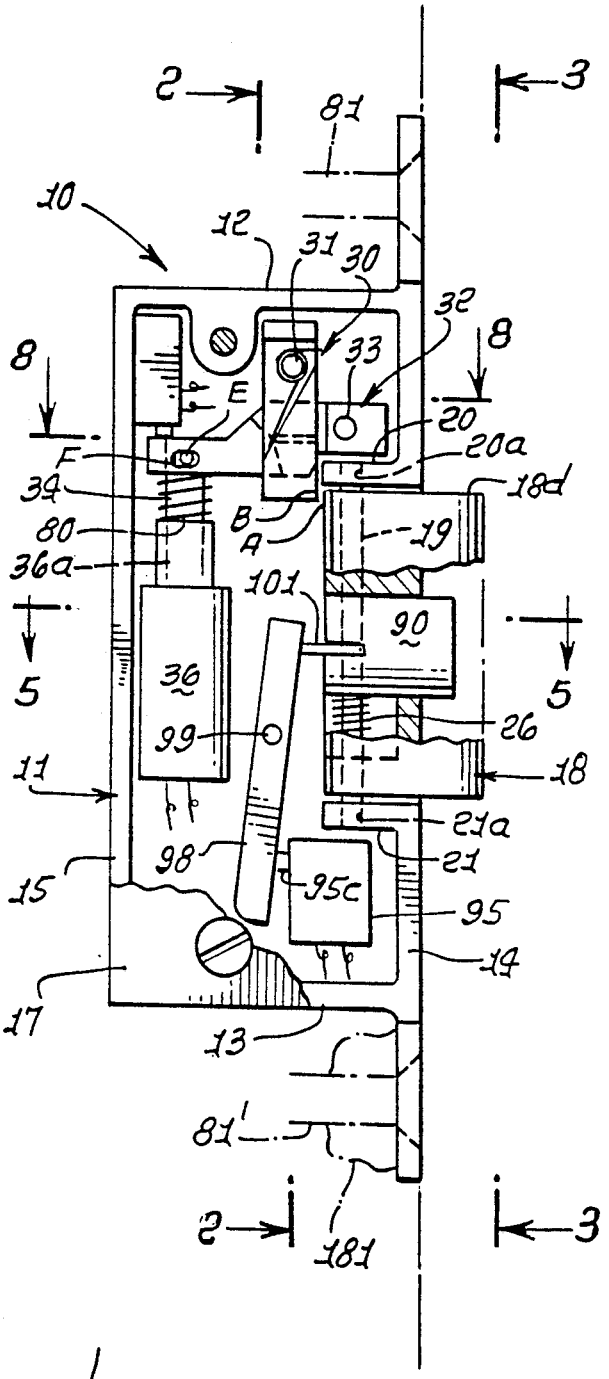
FIG. 1.
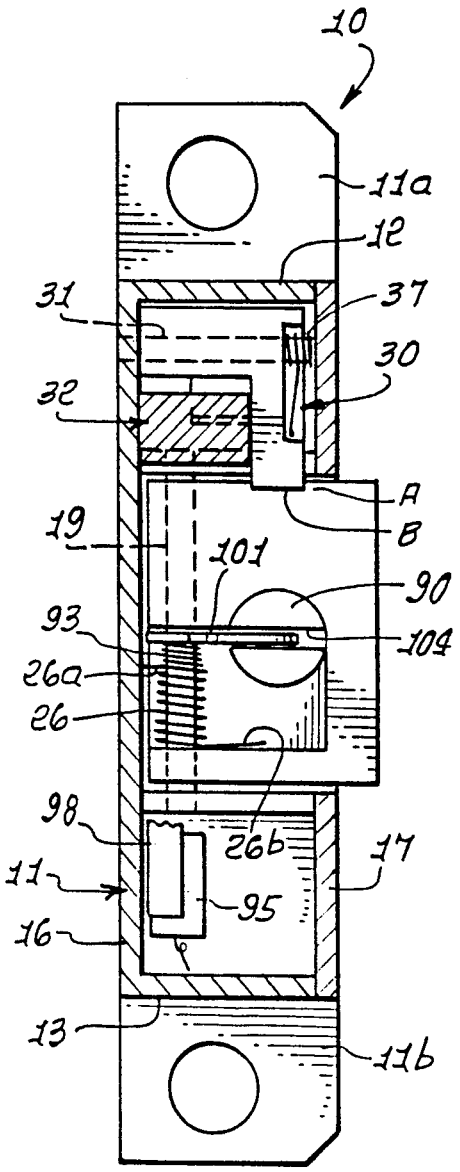
FIG. 2.
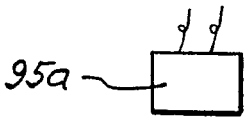

FIG. 8.
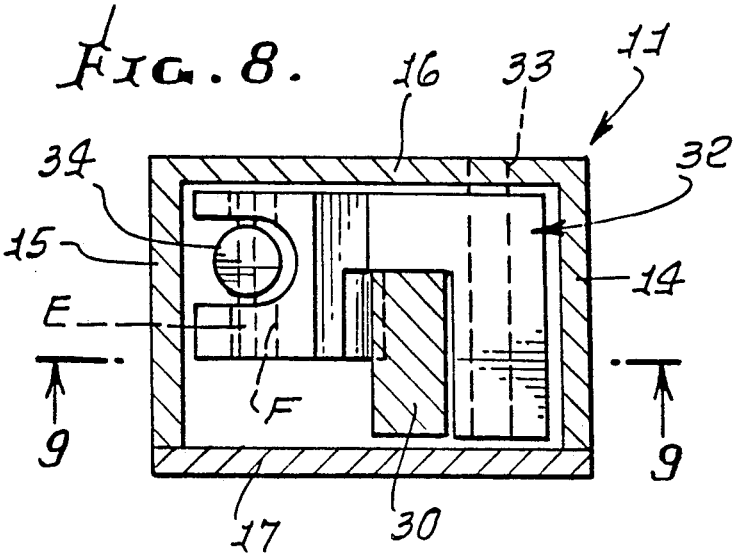
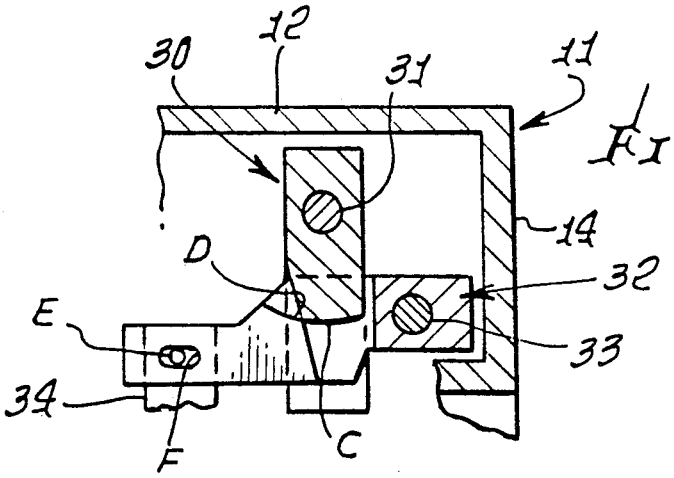
FIG. 9.
FIG. 10.
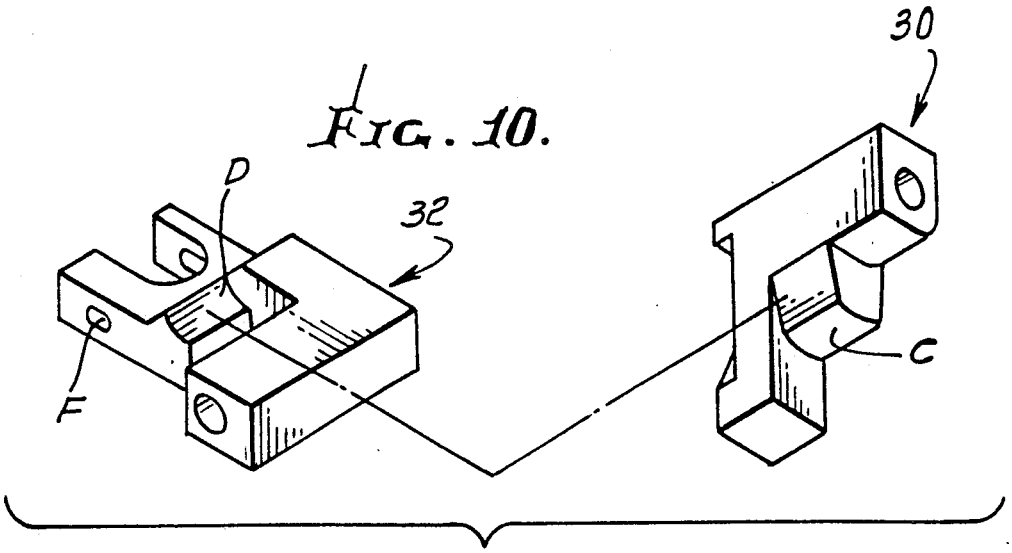

FIG. 11.
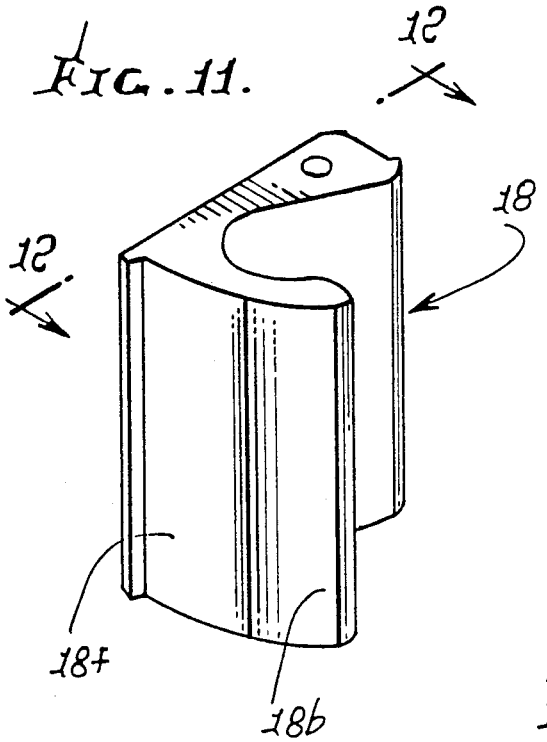
FIG. 12.
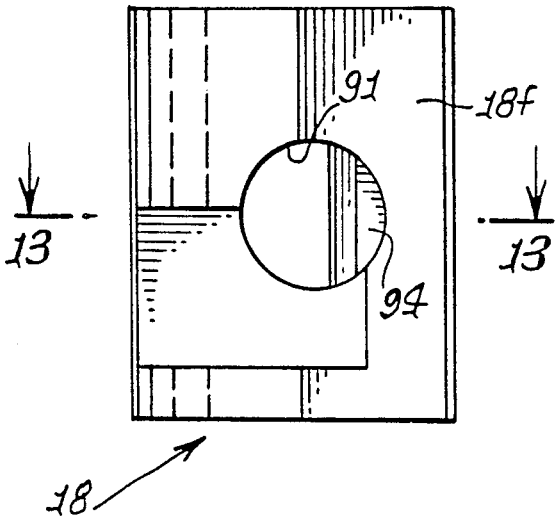
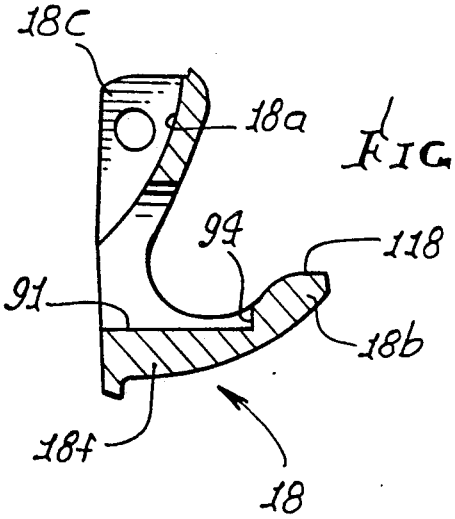
FIG. 13.

COMPACT ELECTRIC STRIKE

BACKGROUND OF THE INVENTION

This invention relates generally to latches, and more particularly, a compact, electrically energizable latch with simple, effective means for signaling the presence and/or absence of a door part blocked by the latch from movement relative to the latch, as for example to open position. Thus, the said means can signal the unblocked or blocked condition of the door or door part.

There is need for the above-described latch and signaling means; and there is also need for the simple, effective, and reliable latch and signaling means described in detail herein. This invention also improves upon that of U.S. Pat. Nos. 4,756,566 and 4,917,425 owned by the assignee of the present invention.

SUMMARY OF THE INVENTION

It is a major object of the invention to provide electrical release, door strike apparatus meeting the above need. Such apparatus, in accordance with the invention, is characterized by:

a) a carrier frame, b) a strike bolt carried by the frame for pivoting when released, allowing door opening, the bolt adapted to receive and resist door opening force prior to such pivoting, c) means carried by the frame to release the strike bolt for such pivoting, including first, second and third arms, d) the first arm movable from a first position blocking bolt pivoting to a second position allowing bolt pivoting to in turn allow door opening, the second arm movable from a primary position in which it holds the first arm in the first position to a secondary position in which it allows first arm movement to the second position, and the third arm movable from an initial position in which it holds the second arm in the primary position to a subsequent position in which it allows movement of the second arm to the secondary position, the third arm movable by a solenoid, e) and means including an element carried by the bolt and movable relative thereto to signal the presence of a door part adjacent the bolt.

It is another object of the invention to provide the said element in the form of a plunger, and the bolt having a bore defining an axis and receiving the plunger for axial movement relative to the bolt. Further, a signaling switch may be carried by or associated with the case, and the said e) means may include motion-transfer mechanism carried in the case and operable to actuate the switch in response to relative movement of the plunger and bolt, and in response to pivoting of the bolt by the door part. Such mechanism may advantageously include two levers carried to pivot relative to the case, one lever sensing movement of the plunger, the other lever operatively connected to the switch, the other lever sensing movement of the one lever.

Yet another object includes the provision of first and second spring means, the first spring means operatively connected with the bolt to urge it into door part blocking position, and the second spring means urging the element into a position to sense the presence of the door part adjacent the bolt. In this regard, a pivot may be provided on the case for mounting the bolt for its pivoting, both the springs associated with the pivot. The pivot may include a shaft, with both the springs comprising torsion springs wrapped about the pivot shaft.

Yet another object is the provision of multiple stop shoulders on or associated with the bolt to limit plunger movement relative to the bolt, and bolt movement relative to the case These and other objects and advantages of the invention, as well as the details of an illustrative embodiment, will be more fully understood from the following specification and drawings, in which:

DRAWING DESCRIPTION

FIG. 1 is a side elevation taken through one form of electric strike apparatus embodying the invention, and shown in blocking position;

FIG. 2 is an elevation taken on lines 2—2 of FIG. 1;

FIG. 8 is a horizontal section taken on lines 8—8 of FIG. 1;

FIG. 9 is an enlarged elevation, partly in section, showing position of trip arm and block arm parts as also seen in FIG. 1;

FIG. 10 is an exploded perspective view of the trip arm and block arm parts, as also seen in FIGS. 1 and 9;

FIG. 11 is a perspective view of the strike bolt seen in FIG. 1;

FIG. 12 is an elevation taken on lines 12—12 of FIG. 11; and

FIG. 13 is a section taken on lines 13—13 of FIG. 12.

DETAILED DESCRIPTION

Figure 5:
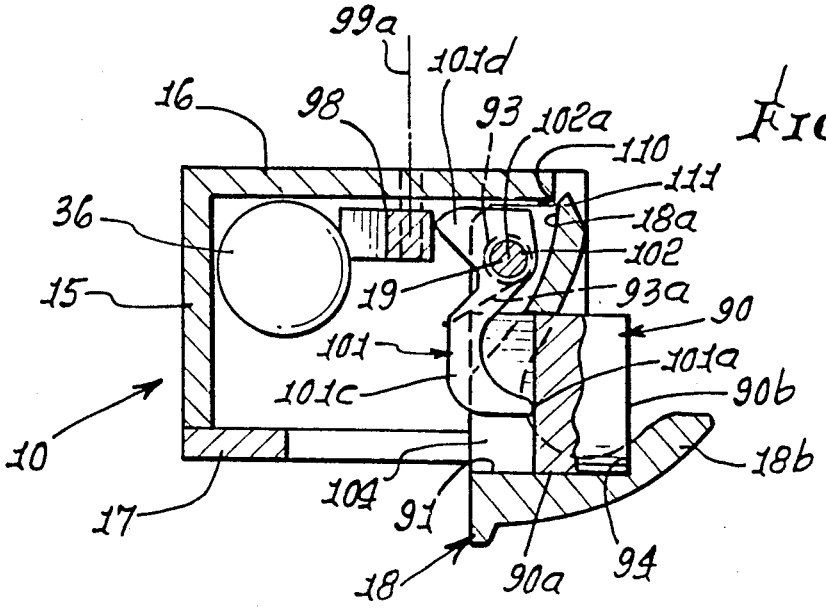
FIG. 5 is a horizontal section taken on lines 5—5 of FIG. 1.
Figure 6:
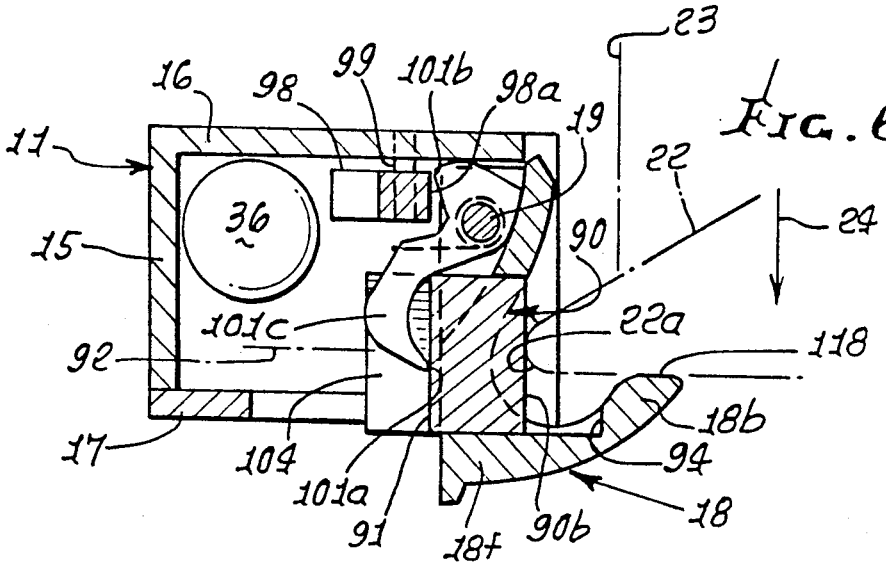
FIG. 6 is a view like FIG. 5 but showing parts in position when a door part engages a strike bolt.
Figure 7:
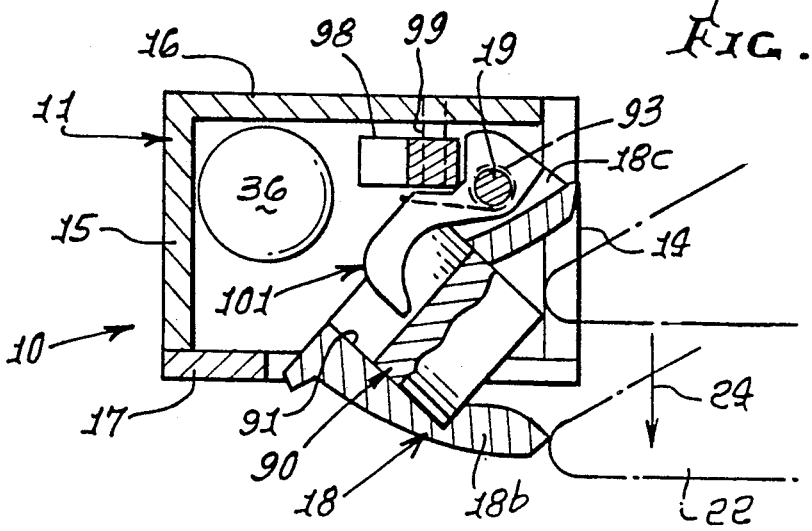
FIG. 7 is a view like FIG. 6 wherein the bolt has pivoted out of door blocking position, allowing the door to open.

As shown in FIGS. 1, 2, and 5–8, device 10 includes a latch case or carrier frame 11 having top and bottom walls 12 and 13, front and rear walls 14 and 15, and left and right side walls 16 and 17. Wall 17 is typically a cover. The case may have flanges or tabs **11*a* and 11*b* to be attached as by fasteners 81 and 81' to a door frame 181. A vertically elongated strike bolt 18 is pivotally attached to the case, as by a vertically elongated pin 19 received through an opening in bolt flange or flanges 18*c*. Opposite ends of the pin are retained in openings 20*a* and 21*a* in case flanges 20 and 21 (see FIG. 1); and the rearside of the bolt is recessed at 18*a* to receive the pin, as seen in FIG. 5, whereby the bolt pivots about the vertical axis of the pin between locked or blocking condition, as seen in FIGS. 5 and 6, and unlocked or unblocking condition, as seen in FIG. 7**.

In locked condition, the hook **18*b* of the bolt overlaps a part 22 in or on a door 23 to prevent swinging of the door in a direction 24. See FIG. 6. In inwardly (clockwise) swung, retracted bolt position, as seen in FIG. 7, the overlap of the hook 18*b* and part 22 is removed, so that the door can then swing in direction 24. A "large" torsion spring 26 is wrapped about pin 19 to yieldably urge the bolt toward locked position, as seen in FIGS. 1, and 2. One arm 26*a* of the spring 26 bears against the case, and the other arm 26*b*** bears against the bolt.

Means, including three arms and a solenoid, are provided within the case to release the strike bolt for pivoting between locked and unlocked positions, as referred to. Such arms are indicated as follows:

1. A first (blocking) arm, as at 30, pivotally connected to the case by pin 31, and movable clockwise in FIGS. 1 and 4 (for example) from a first position (see FIG. 1) blocking bolt pivoting to a second position (see FIG. 4) allowing (i.e., unblocking) bolt pivoting to FIG.. 7 position, which in turn allows door opening;
2. a second (release) arm, as at 32, pivotally connected to the case by pin 33, and movable (clockwise for example) from a primary position (see FIG. 1) in which it holds the first arm in its first position, to a secondary position (see FIG. 4) in which the second arm then allows first arm movement to its second position; and e. a third (trip) arm or plunger, as at 34, movable by downstroking of a plunger 36*a* from an initial position (see FIG. 1) in which it holds the second arm 32 in primary position, to a subsequent position (see FIG. 4) in which it effects or allows movement of the second arm to its secondary position, as referred to.

Figure 4:
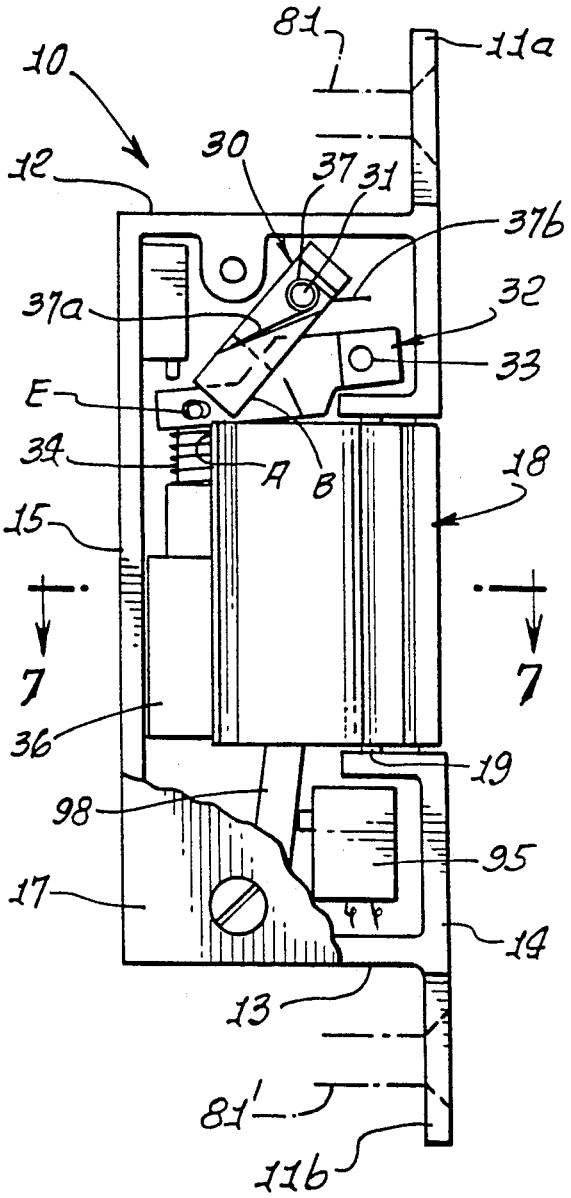
FIG. 4 is a view like FIG. 1 showing the apparatus in unblocking position.
Figure 3:
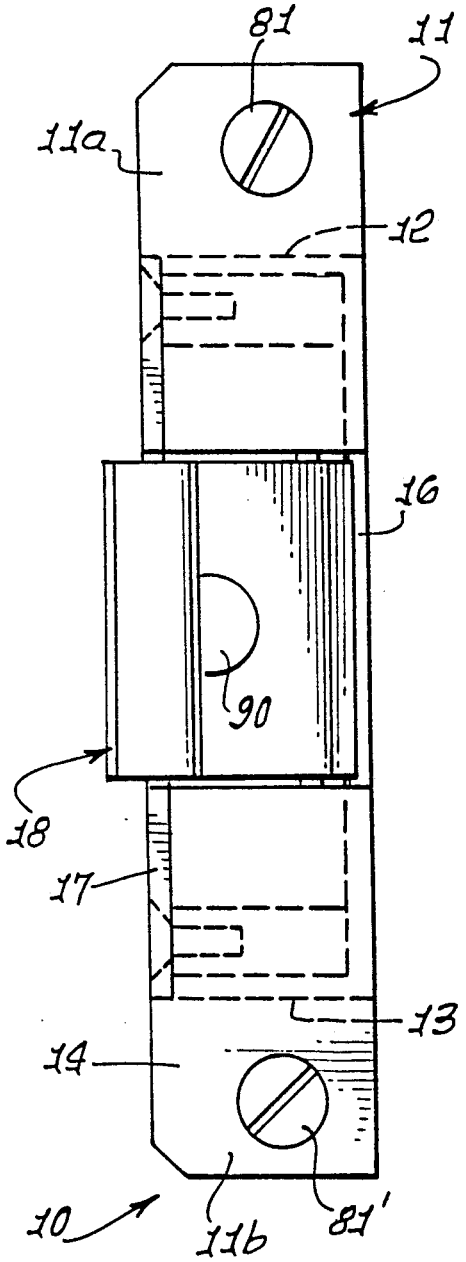
FIG. 3 is an elevation taken on lines 3—3 of FIG. 1.

Note that axes about which arms 30 and 32 pivot are normal to the plane of FIG. 1, whereas the axis along which arm 34 moves is parallel to the plane of FIG. 1. Also note the following:

i) The bolt and the first arm 30 have interengageable cam surfaces A and B, respectively, in FIG. 1, these surfaces being relatively displaced in FIG. 4 (i.e., as arm 30 pivots clockwise up, as in FIG. 4, it allows bolt top flange 18*d* to move relatively leftwardly) as the bolt pivots about pin 19.

ii) The first arm 30 and the second arm 32 have interengaged or interferring curved cam surfaces C and D in FIG. 9, these being relatively displaced in FIG. 4. Arm 32 is swung downwardly by arm 34, allowing arm 30 to be pivoted leftwardly and upwardly, under the influence of bolt cam surface A, as the bolt is moved leftwardly by part 22; a torsion spring 37, coiled about pin 31, acts to urge arm 30 counterclockwise to the position seen in FIG. 4. See spring leg 37*a* bearing on the arm 30, and leg 37*b* bearing on the case, and also stop shoulder on 20, limiting pivoting of arm 30.

iii) The second arm 32 and the third arm 34 have interengaged tongue and groove surfaces E and F in FIG. 1 (surface F being a slot forward in an extension of arm 32), these surfaces being relatively displaced in FIG. 4 (i.e., arm 34 is displaced downwardly by plunger 36*a* of solenoid 36 to allow arm 30 to pivot leftwardly, in FIG. 4). Arm 34 is yieldably held upward in FIG. 1 by a torsion spring 80 when the solenoid is not activated.

It is clear from the above that the provision of these arms allows a solenoid 36 of lightweight construction to control movement of a heavy-duty bolt, for a door, as for example a building door, the three arms located in very compact relation in a small case 11.

In accordance with an important aspect of the invention, means is provided to signal to a remote location the presence of a door part, relative to the bolt. For example, such means may include an element carried by the bolt 18 to be movable relative thereto, and to signal the presence of door part 22, adjacent the bolt, as in FIG. 6. In the example, the referenced element takes the form of a plunger 90 having a cylindrical surface 90*a* axially slidable in a bore 91 formed in the L-shaped body 18*f* of the bolt. (See FIG.. 13.) See also plunger axis 92. A second, "smaller" torsion spring 93 wrapped on pin 19 normally urges the plunger 90 rightwardly to seat at bolt shoulder 94 (see FIG. 5). Spring 93 has an arm 93*a* engaging a lever 101 acting against the left end of the plunger to urge it rightwardly in FIG. 1, and to seat as in FIG. 5.

The means to signal the presence of the door part, in the example, also includes a microswitch 95 carried by the case, and motion-transmitting means for effecting operation of the microswitch in response to motion of the plunger 90, as from the position seen in FIG. 5 to the position seen in FIG. 6, the latter showing the convex top 22*a* of door part 22 engaging the flat end surface 90*b* of the plunger. Such motiontransmitting means may advantageously include an elongated lever arm 98, pivoted to the case at 99, to pivot about an axis 99*a* parallel to the axes of pivots at 31 and 33; and the motion-transfer (lever) arm 101 (see FIGS. 5–7) pivoted to the case at 102 to pivot about an axis 102*a* normal to the plane of FIG. 5 (which is parallel to the axis 99*a*). Arm 101 has a cam shoulder 101*a* at one end thereof that bears against the flat, internal surface 90*b* of plunger 90; and a cam shoulder 101*b* at the opposite end of arm 101 that bears against the flat side face 98*a* of arm 98.

Arm 101 has extent 101*c* yieldably received in a slot 104 in the plunger 90, slot 104 defining a plane parallel to the plane of FIG. 5. Pivot 102 is offset to one side of the plunger 90, so that the effective length of arm extent 101*d* is substantially shorter than the effective length of arm extent 101*c*, whereby relatively large (door part 22 induced) axial motion of the plunger 90 is accommodated to relatively small angular displacement of the arm 98 to actuate the microswitch 95. Microswitch plunger 95*c* is spring urged to urge arm 98 clockwise, to engage the nose 101*b* of lever 101. Also, a very compact assembly is achieved by virtue of the location of the parts, as shown and described. When the switch 95 is activated, it signals to remote location 95*a* that the door is in closed position (i.e., see FIG. 6). When the switch is deactivated, as in FIG. 7, it signals opening of the door.

FIGS. 5–7 show interengageable stop shoulders 110 and 111 on the case and on the bolt to limit clockwise pivoting of the bolt (as urged by spring 26) in bolt FIGS. 5 and 6 positions, in which door part 22 is blocked by bolt extent 18*g* from moving in the direction of arrow 114. Such movement is unblocked in FIG. 7, in response to operation of the solenoid to release "catch" arm 32, allowing door part movement in direction 24, during which the part 22 cams against the bolt shoulder 118, to pivot the bolt from FIG. 6 to FIG. 7 position. At the same time, the part 22 rides off the end 90*b* of the plunger 90, allowing it to move rightwardly and relative to the bolt (to seat at 94) as the bolt pivots back to FIG. 5 position, signaling the microswitch that the door part 22 is no longer present.

I claim:

1. In an electrical release door strike, the combination comprising a) a carrier frame, b) a strike bolt carried by the frame for pivoting when released, allowing door opening, the bolt adapted to receive and resist door opening force prior to said pivoting, c) means carried by the frame to release the strike bolt for such pivoting, including first, second and third arms, d) the first arm movable from a first position blocking bolt pivoting to a second position allowing bolt pivoting to in turn allow said door opening, the second arm movable from a primary position in which it holds the first arm in said first position to a secondary position in which it allows the first arm movement to said second position, and the third arm movable from an initial position in which it holds the second arm in said primary position to a subsequent position in which it allows movement of the second arm to said secondary position, e) and means including an element carried by the bolt and movable relative thereto to signal the presence of a door part adjacent the bolt.

2. The combination of claim 1 wherein said element comprises a plunger and said bolt has a bore defining an axis and receiving the plunger for axial movement relative to the bolt.

3. The combination of claim 2 including a switch associated with the case, and said means including motion transfer mechanism carried in the case and operable to actuate the switch in response to relative movement of the plunger and bolt, and in response to pivoting of the bolt by the door part.

4. The combination of claim 3 wherein said mechanism includes two levers carried to pivot relative to the case, one lever sensing movement of the plunger, the other lever operatively connected to the switch, the other lever sensing movement of said one lever.

5. The combination of claim 1 including first and second spring means, the first spring means operatively connected with the bolt to urge it into door part blocking position, and the second spring means urging the element into a position to sense the presence of said door part adjacent the bolt.

6. The combination of claim 5 including a pivot on the case mounting the bolt for said pivoting thereof, both said springs associated with said pivot.

7. The combination of claim 6 wherein said pivot includes a shaft, and said springs comprise torsion springs wrapped about said pivot shaft.

8. The combination of claim 2 including a stop shoulder on the bolt and engageable by the plunger, there being a spring operatively urging the plunger in a direction toward said stop shoulder in the absence of engagement of said door part with said plunger.

9. The combination of claim 8 including stop shoulders on the bolt and case to interengage and limit bolt pivoting in door part blocking position.

10. The combination of claim 1 including a solenoid carried by the frame to be operatively connected with the third arm, and wherein said third arm has a pivot axis about which it is pivotable in response to operation of the solenoid.

11. The combination of claim 10 including force exerting means yieldably urging the third arm into its said initial position.

12. The combination of claim 2 wherein said first, second and third arms have pivot axes and are pivotally attached to the frame, the frame being a case closely receiving the three arms.

13. The combination of claim 10 including torsion spring means yieldably urging the first arm toward its first position, and the second arm toward its primary position.

14. In an electrical release door strike, the combination comprising a) a carrier frame, b) a strike bolt carried by the frame for pivoting when released, allowing door opening, the bolt adapted to receive and resist door opening force prior to said pivoting, c) means carried by the frame to release the bolt for such pivoting, d) and means including an element carried by the bolt and movable relative thereto to signal the presence of a door part adjacent the bolt.

e) said element comprising a plunger and there being structure associated with the bolt and defining an axis along which the plunger is movable relative to the bolt.

15. In an electrical release door strike, the combination comprising a) a carrier frame, b) a strike bolt carried by the frame for pivoting when released, allowing door opening, the bolt adapted to receive and resist door opening force prior to said pivoting, c) means carried by the frame to release the bolt for such pivoting, d) and means including an element carried by the bolt and movable relative thereto to signal the presence of a door part adjacent bolt.

e) said element comprising a plunger and said bolt has bore defining an axis and receiving the plunger for axial movement relative to the bolt.

16. The combination of claim 15 including a switch associated with the case, and said means including motion transfer mechanism carried in the case and operable to actuate the switch in response to relative movement of the plunger and bolt, and in response to pivoting of the bolt by the door part.

17. The combination of claim 16 wherein said mechanism includes two levers carried to pivot relative to the case, one lever sensing movement of the plunger, the other lever operatively connected to the switch, the other lever sensing movement of said one lever.

18. The combination of claim wherein the plunger defines a slot receiving a portion of said one lever.

19. In an electrical release door strike, the combination comprising a) a carrier frame, b) a strike bolt carried by the frame for pivoting when released, allowing door opening, the bolt adapted to receive and resist door opening force prior to said pivoting, c) means carried by the frame to release the bolt for such pivoting, d) and means including an element carried by the bolt and movable relative thereto to signal the presence of a door part adjacent the bolt.

e) and including first and second spring means, the first spring means operatively connected with the bolt to urge it into door part blocking position, and the second spring means urging the element into a position to sense the presence of said door part adjacent the bolt.

20. The combination of claim 15 including a stop shoulder on the bolt and engageable by the plunger, there being a spring operatively urging the plunger in a direction toward said stop shoulder in the absence of engagement of said door part with said plunger.

21. The combination of claim 17 wherein the bolt defines a stop shoulder limiting movement of the plunger as urged by said one arm.

* * * * *